US008096366B2

(12) United States Patent
Gibson et al.

(10) Patent No.: US 8,096,366 B2
(45) Date of Patent: Jan. 17, 2012

(54) ENVIRONMENTALLY BENEFICIAL AND EFFECTIVE HYDROCHLOROFLUOROCARBON COMPOSITIONS FOR FIRE EXTINGUISHING APPLICATIONS

(75) Inventors: Jeff Gibson, Henderson, NV (US); Bradford Colton, Las Vegas, NV (US)

(73) Assignee: American Pacific Corporation, Las Vegas, NV (US)

( * ) Notice: Subject to any disclaimer, the term of this patent is extended or adjusted under 35 U.S.C. 154(b) by 0 days.

(21) Appl. No.: 13/026,177

(22) Filed: Feb. 11, 2011

(65) Prior Publication Data

US 2011/0297403 A1 Dec. 8, 2011

Related U.S. Application Data

(60) Provisional application No. 61/422,107, filed on Dec. 10, 2010.

(51) Int. Cl.

| | |
|---|---|
| ***A62C 13/64*** | (2006.01) |
| ***A62C 13/62*** | (2006.01) |
| ***A62C 13/00*** | (2006.01) |
| ***A62C 31/00*** | (2006.01) |
| ***A62D 1/08*** | (2006.01) |

(52) U.S. Cl. ..... 169/74; 169/71; 169/45; 169/46; 169/47; 169/48; 169/89; 252/2; 252/8; 252/601; 252/610; 252/611

(58) Field of Classification Search ..... 169/9, 45, 169/46, 47, 71, 74, 89; 252/2, 8, 601, 610, 252/611; 239/589

See application file for complete search history.

(56) References Cited

U.S. PATENT DOCUMENTS

| | | | | |
|---|---|---|---|---|
| 5,615,742 | A * | 4/1997 | Robin et al. | 169/45 |
| 5,695,688 | A * | 12/1997 | Nimitz et al. | 516/8 |
| 5,759,430 | A * | 6/1998 | Tapscott et al. | 252/8 |
| 6,112,822 | A * | 9/2000 | Robin et al. | 169/46 |
| 6,182,768 | B1 | 2/2001 | Andersson | |
| 6,267,788 | B1 | 7/2001 | Andersson | |
| 7,083,742 | B1 * | 8/2006 | Nimitz et al. | 252/8 |
| 7,959,825 | B2 * | 6/2011 | Minor et al. | 252/68 |
| 2004/0195544 | A1 | 10/2004 | Richard et al. | |
| 2008/0089877 | A1 * | 4/2008 | Udell et al. | 424/94.1 |
| 2009/0166175 | A1 | 7/2009 | Waibel et al. | |

FOREIGN PATENT DOCUMENTS

| | | |
|---|---|---|
| CN | 1218702 | 6/1999 |
| WO | WO 0226913 | 4/2002 |
| WO | WO 03024537 | 3/2003 |

(Continued)

OTHER PUBLICATIONS

Restrepo, Guillermo; Weckert, Monika; Brueggemann, Rainer; Gerstmann, Silke; Frank, Hartmut, Environmental Science & Technology (2008), 42(8), 2925-2930.

(Continued)

*Primary Examiner* — Joseph D Anthony

(74) *Attorney, Agent, or Firm* — Knobbe Martens Olson & Bear LLP

(57) ABSTRACT

Compositions are described which are useful in many applications such as fire extinguishing or refrigeration. The compositions may include a hydrochlorofluorocarbon such as 2,2-dichloro-1,1,1-trifluoroethane, a dispersant such as $CF_3I$, and an inert gas such as argon, and may in some embodiments be held under pressure. For example, some fire extinguishing compositions may be composed of 2,2-dichloro-1,1,1-trifluoroethane, $CF_3I$, and argon.

14 Claims, 1 Drawing Sheet

FOREIGN PATENT DOCUMENTS

WO WO 2009086082 7/2009

OTHER PUBLICATIONS

Ural, Erdem A., Process Safety Progress (2003), 22(1), 65-73.

Jain, Atul K.; Briegleb, Bruce P.; Minschwaner, K.; Wuebbles, Donald J., Journal of Geophysical Research, [Atmospheres] (2000), 105(D16), 20773-20790.

Chen, Shu-Lin; Wu, Da-Ke, Guizhou Gongye Daxue Xuebao, Ziran Kexueban (1999), 28(3), 11-14.

Li, Yongda; Chen, Qingyun, Chinese Academy Sciences, Shanghai Inst. Org. Chem., Shanghai, Peop. Rep. China, (2000).

Swaminathan, Saravanan; Visco, Donald P., Jr., Industrial & Engineering Chemistry Research (2005), 44(13), 4798-4805.

Yvon-Lewis, Shari A.; Butler, James H., Journal of Geophysical Research, [Atmospheres] (2002), 107(D20), ACH1/1-ACH1/9.

Sihra, Kamaljit; Hurley, Michael D.; Shine, Keith P.; Wallington, Timothy J., Journal of Geophysical Research, [Atmospheres] (2001), 106(D17), 20493-20505.

Bruno, Thomas J.; Bachmeyer, Gregory M.; Wertz, Kelly H., International Journal of Refrigeration (1998), 21(8), 639-647.

Tapscott et al, Journal of Fluorine Chemistry 101 (2000) 209-213.

* cited by examiner

ENVIRONMENTALLY BENEFICIAL AND EFFECTIVE HYDROCHLOROFLUOROCARBON COMPOSITIONS FOR FIRE EXTINGUISHING APPLICATIONS

CROSS-REFERENCE TO RELATED APPLICATIONS

This application claims the benefit of U.S. Provisional Application No. 61/422,107, filed Dec. 10, 2010, which is incorporated by reference herein in its entirety.

BACKGROUND OF THE INVENTION

1. Field

The embodiments relate to fire suppression with compositions comprising agents such as hydrochlorofluorocarbons, dispersants, and inert gases.

2. Description of the Related Art

A composition comprising a hydrochlorofluorocarbon utilizing $CF_4$ as a dispersant has been sold commercially in the United States in fire extinguishing units since 1994. Concerns over the global warming impact of $CF_4$ have increased the need for alternative dispersants in these and related compositions.

SUMMARY

The compositions described herein are generally useful in many applications such as fire extinguishing or refrigeration. The compositions may comprise a hydrochlorofluorocarbon such as 2,2-dichloro-1,1,1-trifluoroethane, a dispersant such as $CF_3I$, and an inert gas such as argon, and may in some embodiments be held under pressure. Some embodiments provide a composition comprising 2,2-dichloro-1,1,1-trifluoroethane, $CF_3I$, and argon. 2,2-Dichloro-1,1,1-trifluoroethane may have a low ozone depletion potential and global warming potential. Furthermore, $CF_3I$ may have a low global warming potential.

Some embodiments provide a fire extinguishing unit comprising a fire extinguishing composition, such as a composition described herein. Such a fire extinguishing unit or fire extinguishing composition may be an environmentally beneficial alternative to current fire extinguishing units or compositions. In some embodiments, a fire extinguishing unit may comprise a container and a pressure delivery system, such as a pressure delivery system comprising a valve, a hose, and/or a nozzle, wherein said container contains a fire extinguishing composition. In some embodiments, the fire extinguishing composition may be under pressure, for example, it may have a pressure of about 70 psig to about 800 psig.

A fire extinguishing composition may be any composition described herein. In some embodiments, a fire extinguishing composition may comprise: a basis, such as a basis comprising 2,2-dichloro-1,1,1-trifluoroethane; a dispersant, such as a dispersant comprising, or consisting essentially of, $CF_3I$; and an inert gas, such as a gas comprising argon. In some embodiments, the fire extinguishing composition may comprise, or consist essentially, of 2,2-dichloro-1,1,1-trifluoroethane, $CF_3I$, and argon.

Some embodiments provide a fire extinguishing unit, comprising a container and a pressure delivery system, such as a pressure delivery system comprising a valve, a hose, and/or a nozzle. The container may contain a fire extinguishing composition. For example, the fire extinguishing composition may have a pressure of about 70 psig to about 800 psig and consist essentially of 2,2-dichloro-1,1,1-trifluoroethane, $CF_3I$, and argon.

Some embodiments of a fire extinguishing unit may comprise a container, a valve, a hose, and/or a nozzle, wherein said container contains a fire extinguishing composition; wherein the fire extinguishing composition comprises: a basis comprising 2,2-dichloro-1,1,1-trifluoroethane, a dispersant consisting essentially of $CF_3I$, and an inert gas comprising argon.

DETAILED DESCRIPTION OF SOME EMBODIMENTS

Figure 1:
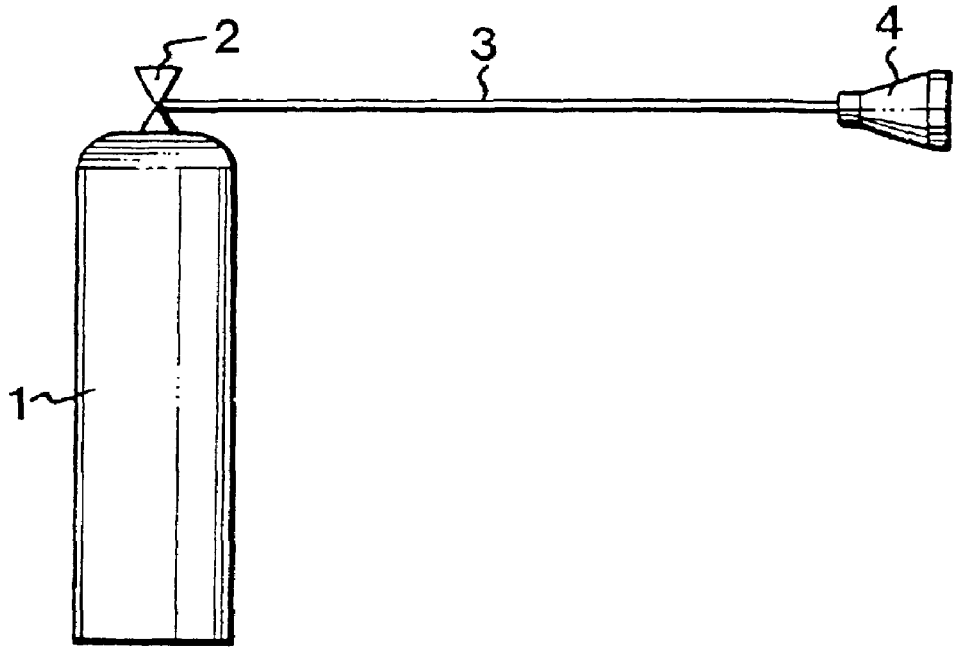
FIG. 1 depicts an embodiment of a hand-held fire extinguishing unit.

The compositions described herein may comprise a hydrochlorofluorocarbon suitable as a basis for a fire extinguishing composition, a dispersant, and an inert gas, and may in some embodiments be held under pressure.

The hydrochlorofluorocarbon may be any hydrochlorofluorocarbon which is suitable as a basis for a fire extinguishing composition. The basis may be any fire extinguishing-active agent comprising at least carbon, fluorine, chlorine, and hydrogen. The fire extinguishing-active capacity may be considered when selecting a suitable compound or combinations of compounds. It may be helpful for a basis to comprise a compound having a high absorbance of radiation within the wavelength range of 3500-7500 Å. It may also be useful if the basis comprises a compound having a molecular weight in the range of 70-400 daltons. Furthermore, it may be useful if the basis comprises a compound which is chemically and physically stable at temperatures below 400° C. It may also be desirable if the basis comprises a compound which is stable in the presence of oxygen. Another useful property for a compound in the basis is an inertion capacity when diluted in fuel-air mixture in the range of 5-60% by volume. Finally, in some embodiments, the basis comprises a compound having a boiling point under about 60° C. or about 70° C. and/or a triple point at or below about −30° C. Examples of useful hydrochlorofluorocarbons may include, but are not limited to, hydrochlorofluoroethanes, hydrochlorofluoropropanes, hydrochlorofluorobutanes, and the like.

In some embodiments, the hydrochlorofluorocarbon comprises 2,2-dichloro-1,1,1-trifluoroethane. This compound is represented by the structure:

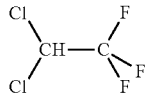

and has a CAS Registry Number of 306-83-2. This compound may also be known by names such as: Ethane, 2,2-dichloro-1,1,1-trifluoro-; 1,1,1-Trifluoro-2,2-dichloroethane; 1,1,1-Trifluorodichloroethane; 1,1-Dichloro-2,2,2-trifluoroethane; 2,2-Dichloro-1,1,1-trifluoroethane; CFC 123; Dichloro(trifluoromethyl)methane; F 123; Fluorocarbon-123; FC-123; Freon 123; Fron 123; HCFC-123; Halocarbon-123; HFA 123; Khladon 123; R 123; Solkane™ 123; FE232™ and other names. In some embodiments, a basis for a fire extinguishing composition consists essentially of 2,2-dichloro-1,1,1-trifluoroethane.

The compositions may further comprise an inert gas. The character of the inert gas may vary, and may include, for example, any composition, compound, or element which is in gaseous state under conditions in which a fire extinguisher may be stored, and which does not react when exposed to fire in such a manner that the fire is promoted. It may also be helpful if the inert gas is capable of functioning as a propellant for the fire extinguishing composition so that it propels the fire extinguishing composition out of a fire extinguishing unit when the fire extinguishing unit is opened. In some embodiments, the inert gas may have a critical temperature at or below about −50° C. It may also be useful for an inert gas to be in gas phase at or above about −50° C. It may also be desirable if an inert gas has an acceptable solubility in the mixture of basis and dispersant, e.g. at least about 0.2% by weight at partial pressures below 70 psig. On the other hand, it is also helpful for the solubility of the inert gas to be low enough to allow the inert gas to achieve an acceptable pressure to act as a propellant. For some fire extinguishing units it may be helpful if the inert gas can produce a propelling pressure between about 20 to about 300 psig, about 29 psig to about 72 psig, about 70 psig to about 220 psig, about 100 psig to about 145 psig, or about 100 psig, in an extinguishing system. Finally, it may be desirable for some inert gases to be capable of inerting the fuel-air mixture, e.g. by displacing oxygen. Some examples of inert gases may include, but are not limited to, $N_2$, He, Ar, Kr, Xe, and combinations thereof.

Extinguishing capacity may be improved if the basis is applied to the base of the flame, and if the basis is able to reach to the fire center. In some circumstances, this process may not be entirely controlled by a propellant or inert gas and mechanical equipment such as a nozzle may be used. Dissolving a dispersant in the basis may improve application of the basis to the flame, and may also help the basis to reach the fire center. A dispersant may be better able to perform its function if it has high solubility in the basis. It may also be helpful if the dispersant has a satisfactory capacity for dispersing the basis. In some embodiments, it may also be helpful if the dispersant is a gas, or close to a gas, after being expelled from the pressurized container for the fire extinguishing agent.

Some properties improve the ability of a dispersant to perform its function, e.g. solubility in the basis and the capacity to help the inert gas or propellant to deliver the composition to a fire. For example, it may be helpful for a dispersant to have a vapor pressure at least 40 psi above that of the basis at about 20° C., and a boiling point that is below −10° C. and at least 30° C. lower than that of the basis. Another property which may be useful for a dispersant may be solubility in the basis in the range of about 0.5% to about 40% by weight. In some embodiments, the dispersant may be soluble in a basis such as in 2,2,-dichloro-1,1,1-trifluoroethane, at a level of: at least about 0.1% by weight, about 1% by weight, or about 5% by weight; and/or up to about 20% by weight, about 30% by weight, or about 50% by weight, when the pressure is about 25 psig at about 20° C. In some embodiments, the dispersant may be soluble in a basis such as in 2,2,-dichloro-1,1,1-trifluoroethane, at a level of at least about 0.2% by weight, about 2% by weight, or about 10% by weight, and/or up to about 30% by weight, about 40% by weight, or about 50% by weight, when the pressure is about 50 psig at about 20° C. In some embodiments, a mixture of the basis and dispersant may result in a pressure of about 36 psig to 72 psig in the extinguishing system and at a temperature from about −30 to about +40° C.

It may also be helpful if a dispersant can quickly expand and disperse the basis in combination with a propellant and nozzle. Different sized droplets may be desirable depending upon the spraying distance and the molecular weight of the basis. It may also be helpful if a dispersant has a high absorbance of radiation within the wavelength range of 3500-7500 Å.

The foregoing paragraphs list several helpful or useful attributes for certain components of the fire extinguishing compositions disclosed herein. As will be appreciated by one skilled in the art, a single composition or component may have one or more of the listed attributes, but they need not have all or any of such attributes to fall within the scope of the inventions disclosed herein.

Some examples of dispersants may include, but are not limited to, carbon dioxide ($CO_2$), helium (He), neon (Ne), krypton (Kr), xenon (Xe), PFC-14 ($CF_4$), HFC-23 ($CHF_3$), HFC-125 ($CHF_2CF_3$), HFC-134a ($CH_2FCF_3$), HFC-227ea ($CF_3CHFCF_3$), trifluoromethyl iodide ($CF_3I$), sulfur hexafluoride ($SF_6$), and the like. In some embodiments, the dispersant may be substantially free of $SF_6$, $CF_4$, $CHF_3$, and/or $CO_2$. $CF_4$ and $CHF_3$ have high Global Warming Potentials (GWPs). The 100 yr integrated time horizon GWP (where $CO_2$=1.0) of $CF_4$ is 7,390. The same for $CHF_3$ is 14,760 (WMO Report NO 50, Scientific Assessment of Ozone Depletion: 2006, Ch. 8). The 100 yr integrated time horizon GWP for $CF_3I$ is <1.

Thus, in some embodiments, a fire extinguishing composition may comprise three components: a basis, a dispersant and a propellant. In some embodiments, the basis may be at least about 60%, about 75%, or about 85%, up to about 95%, about 97%, or about 99% of the weight of the fire extinguishing composition. In some embodiments, the dispersant may be at least about 0.1%, about 1%, or about 4%, and/or up to about 6%, about 10%, or about 15% of the weight of the fire extinguishing composition. For example, in some embodiments, the dispersant, such as $CF_3I$, may be present at about 5% by weight of the fire extinguishing composition. In some embodiments, the basis may comprise, or consist essentially of, 2,2-dichloro-1,1,1-trifluoroethane, and the dispersant may comprise, or consist essentially of, $CF_3I$, wherein the $CF_3I$ may be about 1% to about 5%, about 4% to about 6%, or about 5%, of the weight of the total weight basis and the dispersant, or the weight of the fire extinguishing composition without the inert gas. In some embodiments, the inert gas may be at least about 0.2%, about 0.5%, or about 1%, and/or up to about 2%, about 3%, or about 4% by weight the fire extinguishing composition.

Some embodiments relate to a fire extinguishing unit comprising a composition disclosed herein. The fire extinguishing units may comprise a container filled with a fire extinguishing composition at a working pressure, such as at least about 20 psig to about 800 psig, or about 70 psig to about 450 psig. In some embodiments, a hand-held extinguisher may operate at a pressure of 70 psig to about 220 psig. In some embodiments, a fire extinguishing unit may operate at about 72 psig, 87 psig, or 100 psig to about 150 psig or about 220 psig. In some embodiments, the pressure of a fire extinguishing unit may be: at least about 20 psig, about 29 psig, about 30 psig, about 70 psig, about 72 psig, or 100 psig; and/or up to about 150 psig, 195 psig, 200, psig, 217 psig, 220, psig, 435 psig, 450 psig, 700 psig, 725 psig, or 800 psig; and/or may be about 72 psig, about 87 psig, about 101 psig, about 145 psig, or about 217 psig. In some embodiments, a fire extinguishing composition comprises a liquid component with 2-dichloro-1,1,1-trifluoroethane at a level of 95% by weight and $CF_3I$ at a level of 5% by weight based upon the total weight of the liquid component; and argon at a pressure of about 72 to about 150 psig, or at about 100 psig.

The fire extinguishing unit may comprise a pressure delivery system. One example of a fire extinguishing unit with a pressure delivery system is depicted in FIG. 1. FIG. 1 is a schematic view of a hand-held extinguisher comprising a container 1, a valve 2, a hose 3 and a nozzle 4. In some embodiments, the fire extinguishing unit can be provided with different types of nozzles and the filling degree can be varied, i.e. the container can be filled with a smaller or larger weight of extinguishing agent. In some embodiments, a fire extinguishing unit may comprise a conical nozzle, i.e. having a nozzle member which diverges in the direction of discharging the fire extinguishing agent.

Figure 2:
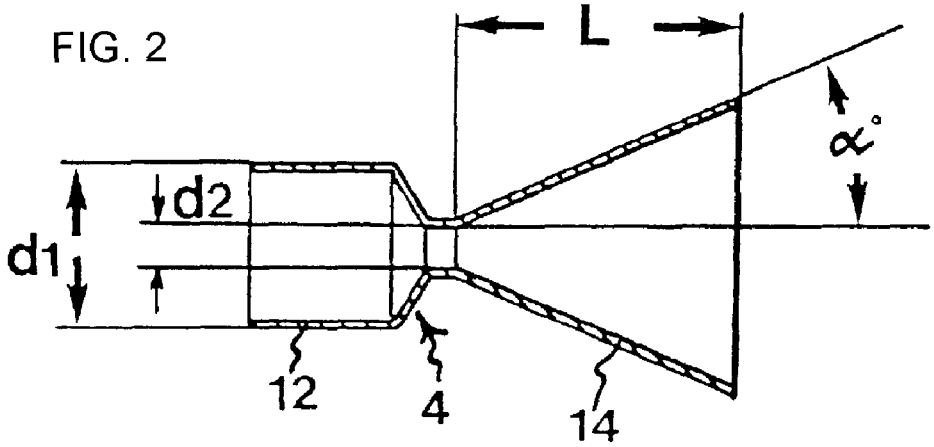
FIG. 2 depicts an embodiment of a nozzle.

FIG. 2 illustrates schematically an embodiment of a nozzle 4. This particular nozzle 4 comprises a connection 12 and a nozzle member 14. The nozzle or the connection has an inlet diameter $d_1$ and the nozzle member an inlet diameter $d_2$. The nozzle member has a length L and an outlet angle $\alpha$. In some embodiments, $d_1$, $d_2$, L and a have the following values.

$$d_2<d_1<1.4d_2$$

$$1.5d_2<L<15d_2$$

$$10<\alpha<40°$$

Some embodiments relate to a method for controlling the spreading of a fire or embers by applying a gas-liquid mixture as stated above.

The degree of filling of the container may depend upon the combination of basis, dispersant and propellant.

In some embodiments, the particular use may affect the design of a nozzle. For example, a nozzle member may be designed to provide a droplet particle size and dispersion ratio of the fire extinguishing composition adapted to the use contemplated. For example, portable fire extinguishers may be adapted to apply a fire extinguishing composition to the fire center by spraying with a hose or some other feature, an improved effect may be achieved if the gas mixture is applied through a nozzle of the design illustrated in FIG. 2. For stationary systems, i.e. total flooding systems, the streaming of the fire extinguishing composition may not be as important. However, it may be important for the dispersion and evaporation of the gas mixture to be as quick as possible.

The relationship between extinguishing-active basis, dispersant and propellant may be important in different fields of application. The extinguishing effect when the fire extinguishing composition is applied directly, as is the case when a portable fire extinguisher is used, may be dependent on the flow rate, e.g. amount of the fire extinguishing composition applied per unit of time, and the spray pattern. For example, if the spray pattern is too concentrated, it may penetrate the flames without any particular extinguishing effect. If the pattern is too finely divided, the fire extinguishing composition or basis may be moved away from the fire by hot fire gases thereby proving ineffective.

EXAMPLE 1

The solubility of $CF_4$, Xe, Kr, $N_2$, Ar, HFC-125, HFC-134a, $CO_2$ and $CF_3I$ in 2,2-dichloro-1,1,1-trifluoroethane (HCFC-123) was tested. For each test, the barometer reading and the ambient temperature was obtained. A pressure tube was weighed, and about 105 mL of HCFC-123 was added to the tube. A vacuum was applied for about 30 seconds, and the weight of the tube and volume of the liquid were recorded. The gas being tested was added to the tube to achieve the following partial pressures: to 25 psia, 50 psia, or 75 psia. The tube pressure, weight, and liquid volume were recorded. These values were used to calculate the solubility of the gas in the HCFC-123 liquid at a given partial pressure. The results, presented in Table 1, show that the solubility of $N_2$ and Ar is substantially lower than the other gases.

TABLE 1

| | Solubility (g/100 g HCFC-123) at given partial pressure | | |
|---|---|---|---|
| Compound | 25 psia | 50 psia | 25 psia |
| $CF_4$ | 0.52 | 0.95 | 1.39 |
| Xe | 2.87 | 5.94 | 8.82 |
| Kr | 0.60 | 1.16 | 1.64 |
| $N_2$ | 0.05 | 0.10 | 0.14 |
| Ar | 0.13 | 0.24 | 0.34 |
| $CF_3I$ | 16.73 | 36.57 | [1] |
| HFC-125 | 7.43 | 19.65 | 31.87 |
| HFC-134a | 21.27 | 57.46 | [1] |
| $CO_2$ | 1.22 | 2.53 | 3.84 |

[1] $CF_3I$ and HFC-134a were not able to reach this partial pressure.

EXAMPLE 2

Compositions of 2,2-dichloro-1,1,1-trifluoroethane plus the additives in Table 2 were subjected to standard UL-711 indoor fire tests. These tests used the exact UL listed hardware configurations commercially available for HCFC Blend B, which utilizes $CF_4$ as a dispersant. The results are depicted in Table 2, with a "P" indicating that the composition passed the test and an "F" indicating that the composition failed the test. A blank entry indicates that the composition was not subjected to that fire test. Tests that did not pass, may pass if re-tested with hardware changes, but this is not desired when evaluating alternative dispersants to $CF_4$ in existing commercial hardware configurations.

TABLE 2

| Additive | 5B (12.5 ft$^2$) pan | 10A wood crib | 1B (2.5 ft$^2$) pan | 2B (5 ft$^2$) pan | 10B (25 ft$^2$) pan | 20B (50 ft$^2$) pan | 2A wood panel |
|---|---|---|---|---|---|---|---|
| 0.5 wt % $CO_2$ | P | | P | P | F | | F |
| 1.1 wt % $CO_2$ | P | | | | | | |
| 1.2 wt % $CO_2$ | F | | | | | | |
| 0.8 wt % HFC-134a | F | | | | | | |
| 1 wt % HFC-134a | F | | | | | | |
| 0.5 wt % HFC-125 | F | | | | | | |
| 1.2 wt % HFC-125 | F | | | | | | |
| 1.5 wt % HFC-125 | F | | | | | | |
| 1 wt % $CF_3I$ | P | | | | | | |
| 2.2 wt % $CF_3I$ | | | | | F | | |
| 3 wt % $CF_3I$ | | | | | F | | |
| 3.5 wt % $CF_3I$ | | | | | F | | |
| 4 wt % $CF_3I$ | | | | | F | | |
| 5 wt % $CF_3I$ | P | P | P | P | P | P | P |

Although the claims have been described in the context of certain preferred embodiments and examples, it will be understood by those skilled in the art that the present claims extends beyond the specifically disclosed embodiments to other alternative embodiments and/or uses and obvious modifications and equivalents thereof. Thus, it is intended that the scope of the claims disclosed should not be limited by the particular disclosed embodiments described above.

What is claimed is:

1. A fire extinguishing unit, comprising a container, a valve, and a nozzle, wherein said container contains a fire extinguishing composition;

wherein the fire extinguishing composition has a pressure of about 70 psig to about 800 psig at about 20° C. and consists essentially of:

2,2-dichloro-1,1,1-trifluoroethane;

$CF_3I$; and argon.

2. The fire extinguishing unit of claim 1, wherein the 2,2-dichloro-1,1,1-trifluoroethane is about 95% by weight of the of the fire extinguishing composition without the argon.

3. The fire extinguishing unit of claim 1, wherein the fire extinguishing composition has a pressure of about 70 psig to about 250 psig at about 20° C.

4. The fire extinguishing unit of claim 1, wherein the $CF_3I$ is about 4% to about 6% by weight of the of the fire extinguishing composition without the argon.

5. A fire extinguishing unit comprising a container and a pressure delivery system, wherein said container contains a fire extinguishing composition, wherein the fire extinguishing composition comprises 2,2-dichloro-1,1,1-trifluoroethane $CF_3I$, and argon.

6. The fire extinguishing unit of claim 5, further comprising a valve, and a nozzle, wherein said container contains the fire extinguishing composition;

wherein the composition comprises:

a basis comprising the 2,2-dichloro-1,1,1-trifluoroethane;

a dispersant consisting essentially of $CF_3I$; and an inert gas comprising argon.

7. The fire extinguishing unit of claim 6, wherein the fire extinguishing composition is substantially free of $CF_4$.

8. The fire extinguishing unit of claim 6, wherein the basis consists essentially of 2,2-dichloro-1,1,1-trifluoroethane.

9. The fire extinguishing unit of claim 6, wherein the fire extinguishing composition has a pressure of about 70 psig to about 200 psig at about 20° C.

10. The fire extinguishing unit of claim 9, wherein the fire extinguishing composition has a pressure of about 100 psig to about 150 psig at about 20° C.

11. The fire extinguishing unit of claim 5, wherein the fire extinguishing composition consists essentially of about 94% to about 96% by weight 2,2-dichloro-1,1,1-trifluoroethane and about 4% to about 6% by weight $CF_3I$ based upon the total weight of the 2,2-dichloro-1,1,1-trifluoroethane and the $CF_3I$; and argon resulting in a composition pressure of about 100 to about 195 psig at about 20° C.

12. The fire extinguishing unit of claim 11, wherein the fire extinguishing composition has a pressure of about 100 psig to 150 psig at 20° C.

13. The fire extinguishing unit of claim 11, wherein the fire extinguishing composition consists essentially of about 95% by weight 2,2-dichloro-1,1,1-trifluoroethane and about 5% by weight $CF_3I$ based upon the total weight of the 2,2-dichloro-1,1,1-trifluoroethane and the $CF_3I$; and argon resulting in a composition pressure of about 100 to about 195 psig at about 20° C.

14. A fire extinguishing unit comprising a container and a pressure delivery system, wherein said container contains a fire extinguishing composition comprising about 94% to about 96% by weight 2,2-dichloro-1,1,1-trifluoroethane, about 4% to about 6% by weight $CF_3I$, based upon the total weight of the basis and the dispersant, and argon.

* * * * *